United States Patent [19]

Ronden

[11] 4,078,867

[45] Mar. 14, 1978

[54] TRAFFIC MARKER POST

[75] Inventor: Clifford P. Ronden, Edmonton, Canada

[73] Assignee: Grandview Industries, Limited, Canada

[21] Appl. No.: 644,044

[22] Filed: Dec. 24, 1975

[51] Int. Cl.[2] ..... E01F 9/00

[52] U.S. Cl. ..... 404/10

[58] Field of Search ..... 404/10, 9, 6, 15; 116/63 R, 63 P, 63 C

[56] References Cited

U.S. PATENT DOCUMENTS

| | | | |
|---|---|---|---|
| 2,774,323 | 12/1956 | Kirk | 404/10 X |
| 3,091,997 | 6/1963 | Byrd | 404/10 |
| 3,371,647 | 3/1968 | Shopbell | 404/10 X |
| 3,502,007 | 3/1970 | Andersson | 404/10 |
| 3,618,556 | 11/1971 | Dittrich | 404/9 X |
| 3,709,112 | 1/1973 | Ebinger | 404/10 |
| 3,713,262 | 1/1973 | Jatcko | 404/6 X |
| 3,802,135 | 4/1974 | Weichenrieder | 404/10 X |

*Primary Examiner*—Nile C. Byers

*Attorney, Agent, or Firm*—Roylance, Abrams, Berdo & Kaul

[57] ABSTRACT

Marker posts, useful for delineating traffic paths, e.g., on highways, airports and parking areas, capable of being impacted and run over by vehicles at sub-zero ambient temperatures, with the post returning to its normal upright position. The posts are extruded tubular bodies of polyethylene modified by an additional polymer selected from the group consisting of ethylene-vinyl acetate copolymers and ethylene-ethyl acrylate copolymers.

7 Claims, 5 Drawing Figures

TRAFFIC MARKER POST

BACKGROUND OF THE INVENTION

A requirement has long existed for markers which can be installed in such a way as to delineate visually the path to be travelled by vehicles. In some cases, as when a roadway is being repaired, the markers are portable, reusable and employed only for short periods of time. In those cases, the requirements have been met by conventional barricades equipped with flashing lights, by the well known "marker cones" fabricated from polymeric material, and by other devices. A more difficult problem arises when it is necessary to provide relatively permanent delineation of highways, airport taxi strips, vehicle parking lots, and the like. For such purposes, it has long been common practice to employ wood posts, suitably treated, painted and installed in the manner of fence posts. Though wood posts have the obvious disadvantage of breaking when struck by a vehicle, they were accepted for many years, but changing circumstances have made wood posts undesirable for a number of reasons. One reason is that the cost of using wood posts has become excessive, due to the increased cost of the post itself, the markedly increasing cost of replacing broken posts, and the cost of maintenance. A perhaps more important reason in the case of highway marker posts results from increased vehicle speeds and traffic densities. When a wooden marker post is struck by a vehicle travelling at a relatively high speed, the post is sheared off and the main body of the post, being freed by the impact, becomes an airborne hazard. On occasion, the body of the post strikes the windshield of a moving vehicle, injuring or killing the occupant.

Seeking to solve such problems, prior-art workers have sought to provide, as replacements for the wooden marker posts, markers made from polymeric materials. U.S. Pat. Nos. 1,668,288, 3,502,007 and 3,709,112 disclose examples of such prior-art efforts. For many applications, particularly those in which the marker is likely to be struck by a vehicle travelling at a substantial speed, or run over by a vehicle at any speed, prior-art proposals have not completely solved the problems, principally because the markers have not been able to satisfy the requirements of long term use and use under winter conditions.

OBJECTS OF THE INVENTION

It is accordingly a general object of the invention to provide a traffic marker post which is free of the deficiencies of the conventional wood posts.

Another object is to devise a traffic marker which will not only survive being struck repeatedly by vehicles under conditions encountered, e.g., in parking lots, but also survive being struck and run over repeatedly by vehicles under the relatively severe conditions encountered when the markers are used as roadway markers.

A further object is to provide such a marker which will survive being impacted by vehicles not only at normal ambient temperatures but also at sub-zero temperatures and yet will serve at temperatures as high as 100° F.

Yet another object is to devise a traffic marker post at least a major portion of which is white and which will retain a high optical visibility over long periods of exposure to severe and varying weather conditions.

A still further object is to provide a marker post which, when run over by a vehicle, will return substantially to its original upright position promptly after being traversed by the vehicle.

SUMMARY OF THE INVENTION

Traffic markers according to the invention comprise an elongated substantially homogeneous tubular main body of polymeric material comprising a fusion blend of 100 parts by weight polythylene of a density of from about 0.910 grams per cu. cm. to about 0.940 grams per cu. cm., 1.5–27 parts by weight of at least one modifier selected from the group consisting of ethylene-vinly acetate copolymers and ethylene-ethyl acrylate copolymers, and 0.5–5 parts by weight of at least one finely particulate white solid material selected from the group consisting of titanium dioxide and zinc oxide, the marker when properly set in upright position being capable of being traversed by a vehicle travelling at speeds up to 60 miles per hour at ambient temperatures ranging from sub-zero to 100° F. without being broken or permanently deformed. In particularly advantageous embodiments, the tubular body of the marker has an outer diameter-to-effective wall thickness ratio of from about 50:1 to about 16:1 and is of substantially continuously curviform transverse cross-section. The tubular body can be of usual post length, typically 5.5 feet, with the upper end portion in the form of a relatively short tubular body of the same composition as the main body but with the addition of carbon black to yield a black color, the upper end portion being of essentially the same cross-sectional size and shape as the main body and secured in matching axial alignment by a fusion bond to the upper end of the main body.

In order that the manner in which the foregoing and other objects are achieved according to the invention can be understood in detail, particularly advantageous embodiments thereof will be described with reference to the accompanying drawings, which form part of the original disclosure hereof, and wherein.

GENERAL DESCRIPTION OF THE INVENTION

Figure 1:
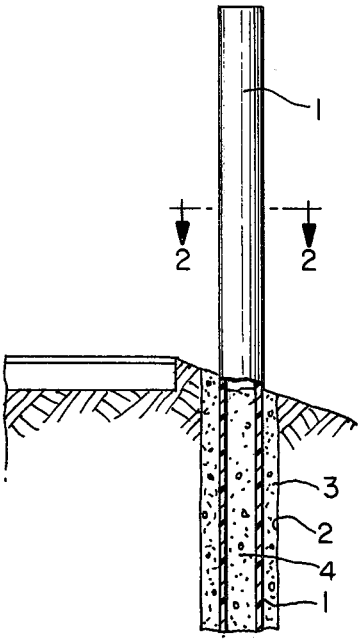
FIG. 1 is a side elevational view of a marker post according to the invention, installed in typical fashion.

Marker posts according to the invention comprise an extruded tubular body of polyethylene modified for both cold temperature deformability and long term weather resistance. The polyethylene employed must be low density polyethylene, i.e., polyethylene having a density of from about 0.910 grams per cu. cm. to about 0.940 grams per cu. cm. To achieve cold temperature deformability and resilience adequate to assure that the post will survive being impacted and traversed by a vehicle at sub-zero temperatures, the extruded polyethylene body includes 1.5–27 parts by weight (per 100 parts by weight polyethylene) of a modifier selected from the group consisting of ethylene-vinyl acetate copolymers and ethylene-ethyl acrylate copolymers. To assure both good visibility and the ability to withstand prolonged weathering without discoloration or polymer deterioration, the post comprises 0.5–5 parts by weight of a white finely particulate solid material selected from the group consisting of titanium dioxide and zinc oxide. To further improve weatherability, minor proportions, typically 0.1–1.5 parts by weight, of a conventional organic ultra-violet absorbing agent such as tris (nonylphynyl) phosphite, dilauryl thiodipropionate, or a polyester of terephthalic acid with pheno or resorcinol can be included.

The ethylene-vinyl acetate copolymers and ethylene-ethyl acrylate copolymers broadly are useful according to the invention, so long as the copolymer includes at least 4% by weight of vinyl acetate and/or ethyl acrylate. It is advantageous to use as the modifier a combination of the two copolymers, the use of equal amounts of ethylene-vinyl acetate and ethylene-ethyl acrylate being particularly effective.

In addition to the foregoing formulation, the post is tubular, has an outer diameter-to-effective wall thickness ratio of from about 50:1 to about 16:1, and is of substantially continuously curviform transverse cross section. As used herein, the term "substantially continuously curviform transverse cross section" refers to a closed wall shape which has no flat or other discontinuity amounting to more than one-fifth of the total periphery.

The marker posts are fabricated by conventional melt extrusion, with the formulation prepared by dry blending. Extrusion is accomplished with pipe extrusion equipment and conditions appropriate for melt extrusion equipment and conditions appropriate for melt extrusion of low density polyethylene.

The following formulations in parts by weight, are typical:

| Formulation | Polyethylene | Ethylene-Vinyl Acetate Copolymer | Ethylene-Ethyl Acrylate Copolymer | Titanium Dioxide | Zinc Oxide | Organic Ultra-Violet Absorber |
|---|---|---|---|---|---|---|
| 1 | 100 | 10 | — | 4 | — | — |
| 2 | 100 | 10 | — | 3 | — | 1 |
| 3 | 100 | — | 9 | 3 | — | 1 |
| 4 | 100 | 10 | — | — | 4 | — |
| 5 | 100 | — | 9 | — | 4 | — |
| 6 | 100 | 5 | — | 1 | — | — |
| 7 | 100 | — | 4 | — | 1 | — |
| 8 | 100 | 4 | — | 1 | — | .5 |
| 9 | 100 | 10 | 10 | 1 | — | .5 |
| 10 | 100 | — | 20 | 1 | — | .5 |
| 11 | 100 | 20 | — | 1 | — | .5 |

In general, increasing the proportion of the modifying polymer or polymers increases the ability of the post to survive traversal by a vehicle at sub-zero temperatures. Thus, when the formulation includes 10 parts by weight of ethylene-vinyl acetate copolymer or ethylene-ethyl acrylate copolymer per 100 parts by weight polyethylene, is of substantially continuously curviform transverse cross-section and has a maximum outer diameter-to-effective wall thickness ratio of at least 20:1, the post will survive repeated traversal by vehicles at temperatures at least as low as −10° F. Increasing the proportion of modifying polymer or polymers to 20 parts by weight per 100 parts by weight polyethylene makes the post acceptable for use at temperatures at least as low as −40° F. Increasing the outer diameter-to-effective wall thickness ratio generally improves the ability of the post to survive traversal by vehicles at low temperatures, but decreases the maximum temperature at which the post will remain physically stable.

Figure 2:
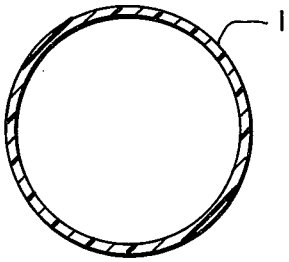
FIG. 2 is an enlarged transverse cross-sectional view taken on line 2—2, FIG. 1.

As illustrated in FIGS. 1 and 2, the marker post 1 can be in the form of a right cylindrical body open at both ends. The post is typically 5½ ft. long and 3½ in. in outside diameter, with a wall thickness of 0.150 in., so that the outer diameter-to-wall thickness ratio is approximately 23:1. The post is installed by being inserted in a dug hole 2, FIG. 1, with the hole being oversize and the space between the wall of the hole and the post being filled with sand as indicated at 3. Additionally, the post itself is filled with sand, to approximately ground level, as shown at 4.

Figure 3:
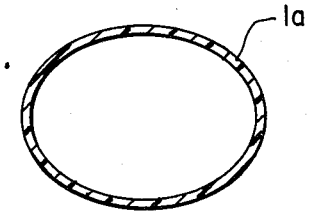
FIGS. 3 and 4 are cross-sectional views, similar to FIG. 2 but showing alternative cross-sectional shapes for the marker post of FIG. 1.
Figure 4:
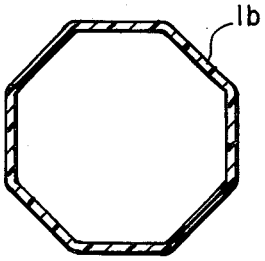

Advantageously, the transverse cross-section of the post is circular, as seen in FIG. 2. Alternatively, the post 1*a* can be of elliptical transverse cross-section, as shown in FIG. 3, in which case the post is installed with the long axis of the ellipse extending transversely of the intended path of travel of vehicles to be guided thereby. As seen at 1*b* in FIG. 4, the post can be of polygonal transverse cross-section, so long as no flat side of the polygon is longer than 1/5 of the total cross-sectional periphery.

Employing the formulations described, the marker post 1 will present a bright white appearance throughout its length and will retain that appearance throughout the prolonged periods of weathering without deterioration other than by deposits which can be removed by cleaning without more difficulty than is involved in cleaning the usual painted wood posts. Marker posts according to the invention are more than adequately resistant to the action of the road salt and to periods of prolonged sunlight.

Figure 5:
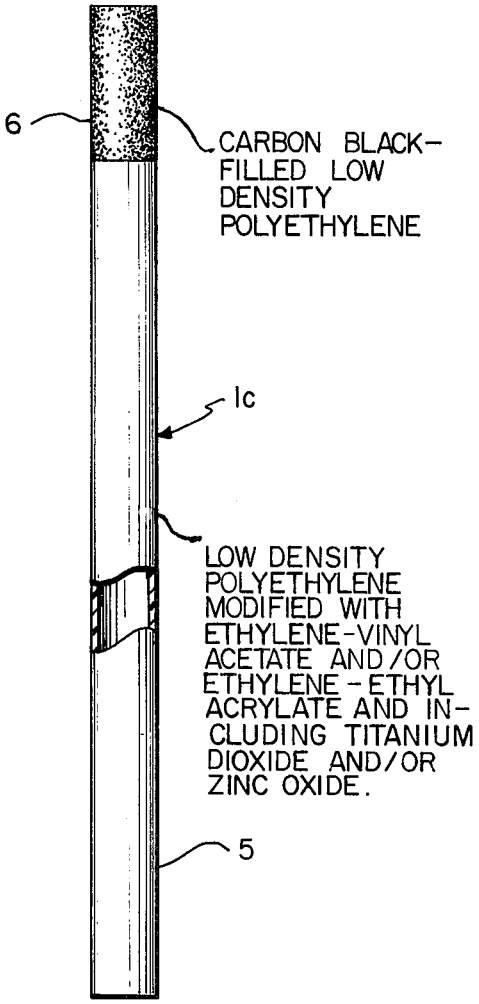
FIG. 5 is an elevational view of a marker post according to another embodiment of the invention.

To increase daylight visibility, the marker posts are advantageously provided with an upper end portion of a dark color, advantageously black, as by securing such a portion in end-wise alignment to the main body portion of the post. Advantageously, the darker upper end portion is of the same composition as the main body portion but with a coloring ingredient substituted for the white pigment and is secured to the main body portion by fusion welding. Thus, as seen in FIG. 5, the post 1*c* can comprise a main body portion 5, and an upper end portion 6, portions 5 and 6 being of like transverse cross-sectional size and configuration. Main body portion 5 is extruded from a polyethylene of the density specified above, modified with ethylene-vinyl acetate copolymer and/or ethylene-ethyl acrylate copolymer and filled with titanium dioxide or zinc oxide according to the above formulations. The upper end portion 6 is extruded from the same composition but with carbon black substituted for the white pigment. Alternatively, the upper end portion can be made orange by using a molybdate pigment or a cadmium sulfide and/or cadmium sulfoselenide pigment in place of carbon black. The following examples are illustrative:

EXAMPLE 1

Preparatory to extrusion, the following blend was prepared, using conventional dry blending procedures:

| Ingredient | Parts by Weight |
|---|---|
| Polyethylene[1] | 100 |
| Ethylene-vinyl acetate copolymer[2] | 4 |
| Titanium dioxide | 1 |
| Ultra-violet absorber | 0.5 |

[1]Density of 0.928 grams per cu. cm., melt index of 0.15
[2]Approximately 30% by weight vinyl acetate The dry blend was extruded using a conventional 2½ in., screw-operated, liquid cooled extruder equipped with a mixing head type screw having an L/O ratio of 24:1. The extruder was fitted with a pipe extrusion die having a die opening of 4.000 in. and a mandril diameter of 3.400 in. The temperature profile was maintained as linearly increasing from 270° F. at the feed zone to 310° F. at the die exit. The screw speed was 65 r.p.m. and the extrusion rate 3.5 ft. per min. The extruded product was run through a conventional vacuum sizer and then through a 20 ft. cooling tank, with the water temperature maintained at approximately 65° F. at the vacuum sizer and cooling tank. Haul-off was accomplished with a conventional gum rubber endless belt haul-off unit. The extruded product was a tube of circular transverse cross-section, having an outer diameter of 3.5 in. and a wall thickness of 0.150 in., and was cut into 5½ ft. lengths by a conventional cut-off saw.

One of the posts thus produced was installed generally as shown in FIG. 1 for testing and is hereinafter called Post A. Also installed in the same general fashion was a post (hereinafter Post B) in the form of an extruded tube of white polyethylene (apparently unmodified), the transverse cross section of which was in the form of an isosceles triangle with markedly rounded corners and apex, the base of the triangle being approximately 4 in. and the height to the rounded apex also being approximately 4 in. Both posts were traversed once by the same vehicle travelling at 40 m.p.h. with the ambient temperature at 20° F. Post A bent to the ground and, after the vehicle passed, returned promptly to an approximately upright position, and exhibited only slight signs of crimping at the point at which the post bent. Post B snapped off at ground level on impact by the vehicle.

The tests were repeated with posts according to this example, both with actual vehicle tests and with cold room tests with a swinging arm type adjustable impact machine designed to apply the same foot pounds of force as a vehicle travelling at a predetermined test speed. The tests demonstrated that posts produced according to this example will survive repeated impacts and traversals by a vehicle travelling at 60 m.p.h. with the post at temperatures as low as 0° F.

EXAMPLE 2

Post bodies of the same cross-sectional dimensions referred to in Example 1 were extruded as in Example 1 but from the following dry blend:

| Ingredient | Part by Weight |
|---|---|
| Polyethylene[1] | 100 |
| Polyethylene-ethylene-vinyl acetate copolymer[2] | 20 |
| Titanium dioxide | 1.25 |

-continued

| Ingredient | Part by Weight |
|---|---|
| Ultra-violet absorber[3] | 0.6 |

[1]As in Example 1
[2]Commercial product marketed by U.S.I. Chemicals Co., 99 Park Ave., New York, NY 10016, as EVA No. 645-00, having a vinyl acetate content of 28% by wt., balance polyethylene
[3]Commercial product marketed by Amer. Cyanamid Co., Bound Brook, NJ 08804, as CYASORB UV 531, the product being based on a substituted benzotriazole The extruded product was bright white and had the same high weather resistance as that of Example 1. The extruded product was cut into 56 in. lengths. A black tubular extrusion was made, using the same formulation but with carbon black substituted for the titanium dioxide, the black extrusion having the same diameter and wall thickness as the 56 in. lengths. A 10 in. length of the black, carbon black-filled polyethylene extrusion was butt fusion welded to one end of each 56 in. length of the white extrusion, providing marker posts as shown in FIG. 5. Physical property testing of the extruded posts gave the following results:

| | |
|---|---|
| Melt flow index, Condition E | 0.38 g./10 min. |
| Tensile strength, by ASTM Test Method D638-72 | 2280 p.s.i. |
| Elongation, by ASTM Test Method D638-72 | 505 % |
| Notched Izod Impact, by ASTM Test Method D256-73 at −30° F. | 1.50 ft. lb./in. |

The posts exhibited the same ability to withstand impact and traversal by vehicles at temperatures above 0° F. as did those of Example 1, and of 18 posts subjected to cold room tests with a swinging arm type adjustable impact machine operated to apply the same foot pounds of force as a vehicle travelling 60 m.p.h., only 3 posts failed at −20° F.

EXAMPLE 3

Post bodies were extruded as in Example 2, but employing the following dry blend:

| Ingredient | Parts by Weight |
|---|---|
| Polyethylene[1] | 100 |
| Ethylene-vinyl acetate copolymer[1] | 10 |
| Ethylene-ethyl acrylate copolymer[2] | 10 |
| Titanium dioxide | 1.25 |
| Ultra-violet absorber[1] | 0.6 |

[1]As in Example 2
[2]Commercial product marketed by Union Carbide Corp., 270 Park Ave., New York, NY 10017, as DPDB 6189, containing 18% by weight ethyl acrylate, balance polyethylene The extruded product was bright white and had the same high weather resistance as that of Examples 1 and 2. The extruded product was cut into 56 in. lengths. A black extrusion having the same diameter and wall thickness as the 56 in. white body portions. The black extrusion was cut into 10 in. lengths and one such length was butt fusion welded to one end of each of the white bodies, providing a completed post as seen in FIG. 5. Physical property testing gave the following results:

| | |
|---|---|
| Melt flow index, Condition E | 0.33 g./10 min. |
| Tensile strength, by ASTM Test Method D638-72 | 2340 p.s.i. |
| Elongation, by ASTM Test Method D638-72 | 530% |
| Notched Izod Impact, by ASTM Test Method D256-73 at −30° F. | 1.60 ft. lb./in. |

Eighteen of the completed posts were subjected to cold room tests with a swinging arm type adjustable impact machine operated to apply the same foot pounds of force as a vehicle travelling at 60 m.p.h. All samples passed at −20° F.

EXAMPLE 4

Post bodies were extruded as in Examples 2 and 3, but using the following dry blend:

| Ingredient | Parts by Weight |
|---|---|
| Polyethylene[1] | 100 |
| Ethylene-ethyl acrylate copolymer[1] | 20 |
| Titanium dioxide[1] | 1.25 |
| Ultra-violet absorber | 0.6 |

[1]As in Example 3

The extruded product was bright white and had the same high weather resistance as that of the preceding examples. The product was cut into 56 in. lengths. A black extrusion was made, using the same formulation as for the white extrusion of this example, but with carbon black substituted for the titanium dioxide, the black extrusion having the same diameter and wall thickness as the white extrusion. The black extrusion was cut into 10 in. lengths and one such piece was butt fusion welded to one end of each of the white bodies, providing complete marker posts as illustrated in FIG. 5. Physical properties were determined as follows:

| | |
|---|---|
| Melt flow index, Condition E | 0.60 g./10 min |
| Tensile strength, by ASTM Test Method D638-72 | 2190 p.s.i. |
| Elongation, by ASTM Test Method D638-72 | 555% |
| Notched Izod Impact, by ASTM Test Method D356-73 at −30° F. | 13.31 ft.lb./in. |

Eighteen of the completed posts were subjected to cold room tests with the swinging arm type adjustable impact machine operated to apply the same foot pounds of force as a vehicle travelling at 60 m.p.h. All samples passed at −20° F.

What is claimed is:

1. A traffic marker post for highways, airports, parking lots and the like comprising an elongated extruded tubular main body of polymeric material, said body being substantially homogeneous and comprising 100 parts by weight polyethylene of a density from about 0.910 grams per cu. cm. to about 0.940 grams per cu. cm., 1.5–27 parts by weight of at least one modifier selected from the group consisting of ethylene-vinyl acetate copolymers and ethylene-ethyl acrylate copolymers, and 0.5–5 parts by weight of at leaset one finely particulate white solid material selected from the group consisting of titanium dioxide and zinc oxide;

the marker post being capable of being impacted and traversed by a moving vehicle at temperatures at least as low at 0° F., without being broken or permanently deformed, when one end portion of said body is embedded in the ground and at least substantially filled by filler means which is not substantially compressible under forces applied thereto via said body when the post is struck by a vehicle.

2. A marker post according to claim 1, wherein said body has a substantially continuously curviform transverse cross-section and a maximum outer diameter-to-wall thickness ratio of from about 16:1 to about 50:1.

3. A marker post according to claim 2, wherein said body comprises at least 10 parts by weight of said at least one modifier per 100 parts by weight polyethylene, is of substantially continuously curviform transverse cross-section and has a maximum outer diameter-to-wall thickness ratio of at least 20:1; and the post will withstand impact and traversal by a moving vehicle at temperatures at least as low as −10° F.

4. A marker post according to claim 3, wherein said body comprises at least 20 parts by weight of said at least one modifier per 100 parts by weight polyethylene; and the post will withstand impact and traversal by a moving vehicle at temperatures as low as −40° F.

5. A marker post according to claim 4, wherein at least a substantial proportion of said modifier is ethylene-ethyl acrylate copolymer.

6. A marker post according to claim 1, and further comprising a short tubular body of essentially the same cross-sectional size and shape as said main body secured by a butt fusion weld to the upper end of said main body in axial alignment therewith, said short tubular body comprising said polyethylene and said at least one modifier in substantially the same proportions as does said main body and also including an effective proportion of a colorant which contrasts with white.

7. A marker post according to claim 6, wherein said colorant is carbon black.

* * * * *